US006290260B1

(12) United States Patent
Brill

(10) Patent No.: US 6,290,260 B1
(45) Date of Patent: Sep. 18, 2001

(54) METHOD AND APPARATUS FOR SUPPORTING A SNOWBOARD

(76) Inventor: Aaron Brill, 811 Greene St., Silverton, CO (US) 87433

( * ) Notice: Subject to any disclaimer, the term of this patent is extended or adjusted under 35 U.S.C. 154(b) by 0 days.

(21) Appl. No.: 09/517,837

(22) Filed: Mar. 2, 2000

(51) Int. Cl.[7] ..... A63C 11/00
(52) U.S. Cl. ..... 280/809; 280/814
(58) Field of Search ..... 280/809, 814, 280/637, 816, 815; 224/267, 222, 254, 255, 639, 640, 660, 661, 651

(56) References Cited

U.S. PATENT DOCUMENTS 3,366,293 * 9/1966 Fyke ..... 224/5
4,940,255 * 7/1990 Donine ..... 280/809
5,564,729 * 10/1996 Gomez et al. ..... 280/637
5,653,467 * 8/1997 Griffin et al. ..... 280/809
5,951,048 * 9/1999 Slaughter ..... 280/814

* cited by examiner

*Primary Examiner*—Brian L. Johnson
*Assistant Examiner*—Tony Winner
(74) *Attorney, Agent, or Firm*—Robert K Tendler

(57) ABSTRACT

A method and apparatus for preventing injury to an individual who seeks to transport a snowboard on a chairlift includes providing a detachable loop strap which encircles a portion of the snowboard and goes over the individual's knee and/or thigh such that when the individual has one foot in the snowboard binding at one end, the dangling portion of the board is supported by the loop strap over the individual's knee or thigh. In one embodiment, the strap is neither attached to the board nor to the knee or thigh, but rather is looped around both to support the snowboard. Upon reaching the top of the chairlift, the board is released merely by unbuckling and removing the looped strap. One of the advantages of the loop strap is that it prevents ankle and knee injury due to the dangling of the board from one foot as the person rides the chairlift.

5 Claims, 5 Drawing Sheets

METHOD AND APPARATUS FOR SUPPORTING A SNOWBOARD

FIELD OF INVENTION

This invention relates to snowboarding and more particularly to a method and apparatus for supporting a snowboard when an individual is on a chairlift.

BACKGROUND OF THE INVENTION

The sport of snowboarding has become increasingly popular, with the snowboarder transporting the snowboard to the top of a mountain or hill by virtue of the use of a chairlift. In most cases chairlifts which can accommodate snowboards do not have specially designed snowboard footrests which results in the snowboard dangling from one of the individual's feet while riding the chairlift. The individual seeks to transport the snowboard by inserting one of his feet into one binding and leaving the other foot out of the other binding, as the other binding is too far away to support the board using two feet.

There is therefore a need to be able to support a snowboard while the individual is riding a chairlift, be it a double, triple or quadruple chairlift. Moreover, the device which enables the transport of the snowboard should not be limited by the size of the snowboard or the age of the snowboarder.

It will appreciated that in the prior art various methods have been utilized in an effort to support the dangling snowboard during chair-lifting to the top of the mountain. The purpose of the prior art devices is to be able to support the snowboard during chairlift usage.

It will be noted that young children cannot bear the weight of a snowboard on a chairlift for a very long without a bar or foot rest provided for the support of the snowboard.

In an effort to support the snowboard while chair-lifting, in the past a simple toe strap was screwed on to the top of the snowboard between the two bindings. However the screwing of the strap onto the snowboard weakens the snowboard, invalidating the snowboard's warranties. Additionally, these straps get in the way while snowboarding or getting off a chairlift.

Another way for supporting the board during chair lifting was to provide a garter belt type arrangement. The garter belt was velcroed around the top of the calf and connected to one of the bindings by a cable or cord. It was the purpose of the calf to support the dangling end of the snowboard, with the garter attached to the binding through a cord or like device.

It will be appreciated that this type of support for the snowboard is not very comfortable. Moreover the velcro in general gets packed with snow limiting its effectiveness and possibly resulting in an accidental release which causes a sudden drop of the board resulting in tremendous pressure on the knee and ankle. Such a product is called SkyStrap and is manufactured by System Attic, Inc.

It will be appreciated that the SkyStrap in its garter type configuration utilizes a cord not a flat strap and does not even out the pressure on the legs. Moreover, this device does not serve as a footrest for the leg. Further, the device is not easily detached from the binding such that after descending from the chairlift, detachment is not a simple matter.

It will also be noted that the SkyStrap attached to the back of the binding creating an angle which is uncomfortable in the support of the snowboard. Moreover, the garter end to be released is actually put under one's thigh which is uncomfortable and can lead to accidental release.

SUMMARY OF THE INVENTION

In contradistinction to the above methods for supporting a snowboard while on a chairlift, in the subject method, a webbed loop strap is slipped over the free end of the snowboard and is looped over the individual's knee or thigh such that the individual supports the free end of the snowboard by virtue of the co-action of the strap with the board in conjunction with the free foot pressing on the top of the board to tension the strap. Thus when the individual seeks to transport the board on a chairlift, he slips one of his feet in one of the bindings and slips the loop over the free end of the board. The loop is supported by the knee or thigh of the individual's other leg. It will be noted that in one embodiment the webbed strap is provided with a quick disconnect buckle such that when the individual reaches the top of the chair lift, unclipping the buckle causes the strap to fall away from the board at which point it is retrieved and put in the individual's pocket.

Thus the strap is not permanently attached to the board as is the aforementioned toe strap. Nor is the strap attached to a binding as is the garter type device.

The strap, since it is not structurally secured to the snowboard has no effect on the board warranty and provides a comfortable way of supporting the dangling portion of the board when the individual's foot is in the binding supporting one end of the board.

The subject method and apparatus, termed a joint saver, is conveniently stored in the individual's pocket when not in use and can always fasten and unfasten instantly regardless of weather conditions. It also adjusts instantly to all board sizes as well as body sizes since the loop can be adjusted in length. It can be used with snowboards of regular or so-called goofy foot stances, meaning right foot forward or left foot forward. It will be noted that each snowboarder chooses his or her preference with respect to the bindings.

More particularly in one embodiment, the strap is an eight foot long nylon webbing loop strap, one-inch wide, with the thickness being one to two millimeters. The ends of the strap slide into a quick release buckle, in one embodiment a one-inch standard fastening buckle.

In operation, the snowboarder gets on a chairlift with one of his feet in one binding. The snowboarder takes the loop strap webbing out of his pocket and drapes the strap over the free end of the board and then under the back of the board. He then passes the loop over his free leg and snaps the buckle together. Snowboarder then cinches the strap to a perfect fit, which can be done regardless of the chairlift configuration or the size and age of the snowboarder.

It will be appreciated that the strap takes the load off of the leg which bears the entire weight of the snowboard originally and distributes it across the top of the other leg, e.g. at the knee or thigh. The snowboard can now take the foot which was originally dangling and place it on the top of the snowboard. With proper placement of the strap, the leg associated with the foot which is placed in the snowboard binding now has the majority of the weight relieved from it and borne by the strap over the individual's knee or thigh.

The subject method of the snowboard transport relieves knee pain, ankle pain, hip pain and toe pain normally associated with chairlift usage. Moreover, young children who cannot bear the weight of a snowboard on a chairlift for a very long time without a bar or footrest can now carry their boards up the mountain in relative comfort. It will also be appreciated that if the chairlift is provided with a footrest, these footrests do not easily adjust to fit small children or very large adults. The result is that one can suspend ones snowboard with one foot in the binding and without the dangling, since the board is supported by the strap regardless of the existence of or the position of a footrest.

In summary, a method and apparatus for preventing injury to an individual who seeks to transport a snowboard on a chairlift includes providing a detachable loop strap which encircles a portion of the snowboard and goes over the individual's knee and/or thigh such that when the individual has one foot in the snowboard binding at one end, the dangling portion of the board is supported by the loop strap over the individual's knee or thigh. In one embodiment, the strap is neither attached to the board nor to the knee or thigh, but rather is looped around both to support the snowboard. Upon reaching the top of the chairlift, the board is released merely by unbuckling and removing the looped strap. One of the advantages of the loop strap is that it prevents ankle and knee injury due to the dangling of the board from one foot as the person rides the chairlift.

BRIEF DESCRIPTION OF THE DRAWINGS

These and other features of the Subject Invention will be better understood in connection with the Detailed Description in conjunction with the Drawings, of which.

DETAILED DESCRIPTION

Figure 1:
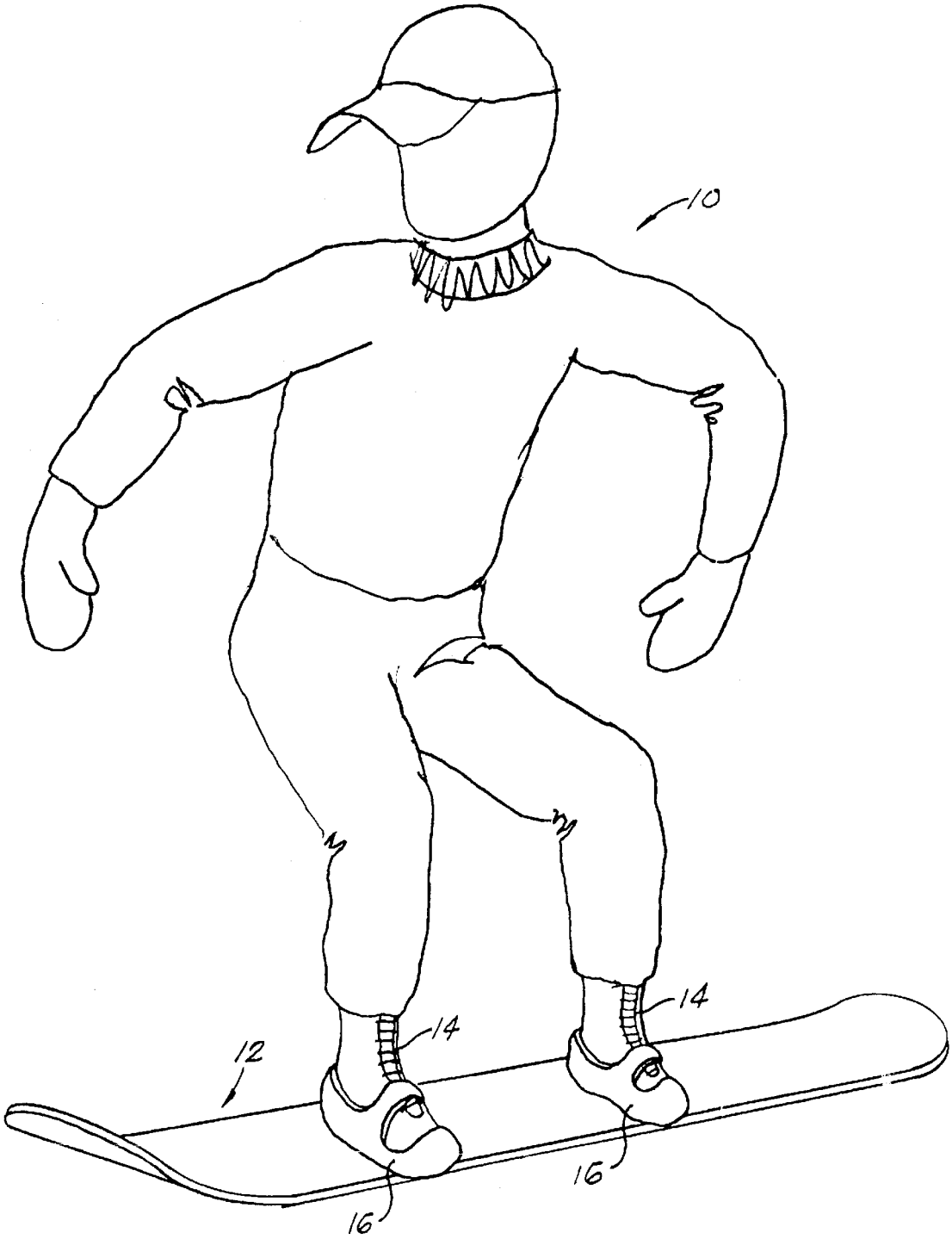
FIG. 1 is a diagrammatic illustration of a snowboarder showing the two bindings normally used.

Referring now to FIG. 1, an individual 10 is shown utilizing a snowboard 12 in which the individual's shoes or boots 14 are captured in respective bindings 16 fixed to the snowboard.

Figure 2:
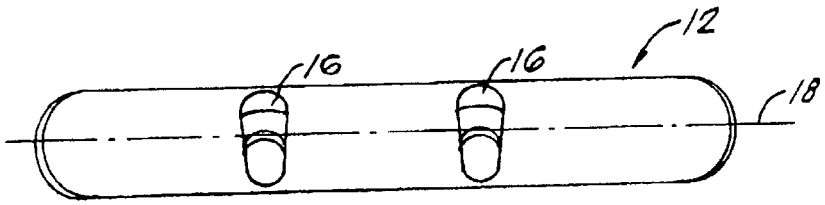
FIG. 2 is a top view of the snowboard FIG. 1 illustrating the transverse orientation of the bindings and the separation thereof.

As can be seen in FIG. 2, bindings 16 are mounted athwart the snowboard perpendicular to center line 18 of snowboard 12.

Figure 3:
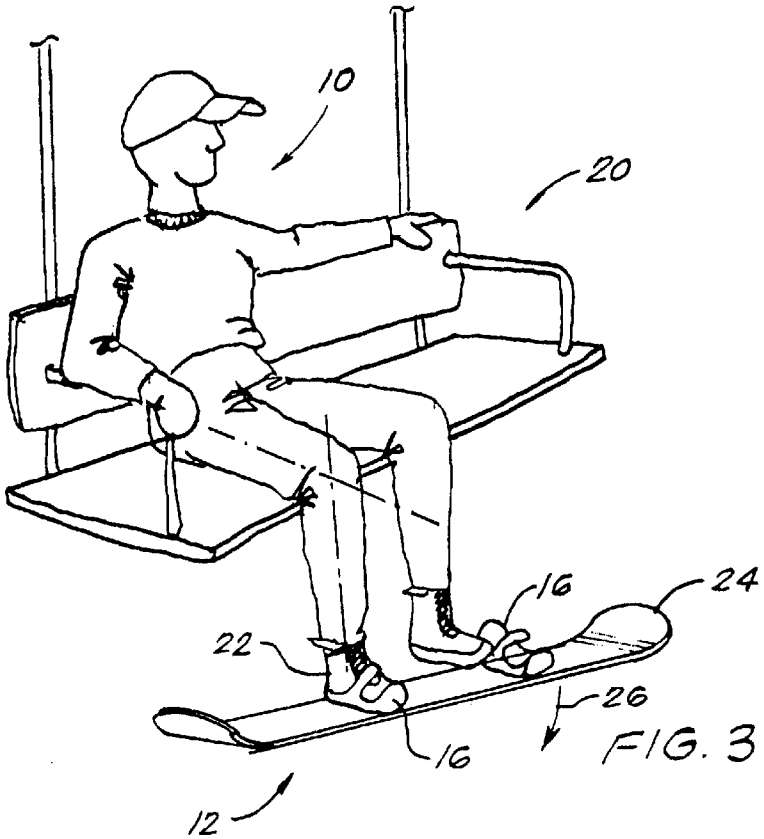
FIG. 3 is a diagrammatic illustration of an individual transporting his snowboard on a chairlift, illustrating that one end of the snowboard dangles from the foot of an individual sitting on the chairlift.

Referring now to FIG. 3, when individual 10 seeks to go up a mountain by virtue of a chairlift 20, snowboard 12 is transported by virtue of the individual's right foot 22 being captured in the associated binding 16.

Because of the space between the bindings, it is impractical and uncomfortable to have both feet in respective bindings when sitting on a chairlift. As a result free end 24 of snowboard 12 dangles beneath the individual as illustrated by arrow 26, causing a great deal of torque not only on the right ankle of the individual but also on his knee.

Sprains and other injuries have occurred during the transport of the snowboard in this manner up the hill or mountain when the individual is sitting on the chair of the chairlift. It will be appreciated in the illustrated embodiment, there are no support bars provided by the chair, at least as far as snowboards are concerned. What support bars are provided are in general for the skiing public and assumes that that the skis will run parallel to the longitudinal center line of the chairlift. However, with snowboards such an orientation is impossible due to the bindings utilized.

Figure 4:
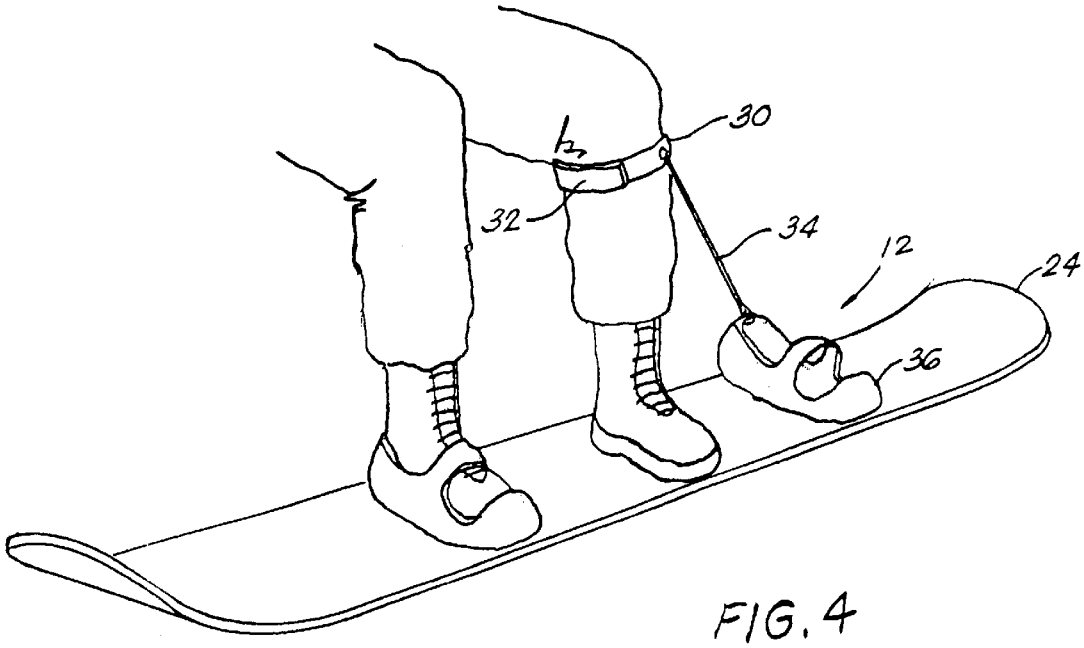
FIG. 4 (PRIOR ART)
FIG. 4 is a diagrammatic illustration of a prior art system for eliminating the dangling of the snowboard during a chairlift transport indicating a velcro garter belt and a cord connecting the garter belt to the free binding of the snowboard.

In the past, and as illustrated in FIG. 4, one prior art system for supporting a snowboard includes a garter assembly 30 attached to the left calf of the individual by a velcro strip 32. This garter assembly is attached via a cable 34 to a binding 36 with an end 24 of snowboard 12 being supported by the tensioning of cable 34 and the attachment of the cable to the garter and thence to the calf of the individual.

As mentioned hereinbefore, this type of board supporting system is both uncomfortable due to the lateral movement of the calf with the downward motion of end 24 due to gravity. Moreover, the velcro attachment may come apart when the velcro has snow on it as would be the case after a run. When snow gets into the velcro attachment mechanism, the velcro can become dislodged causing end 24 of snowboard 12 to drop quickly putting a large torque on the right ankle of the individual, sometimes causing a sprain and on occasion causing a fracture.

Figure 5:
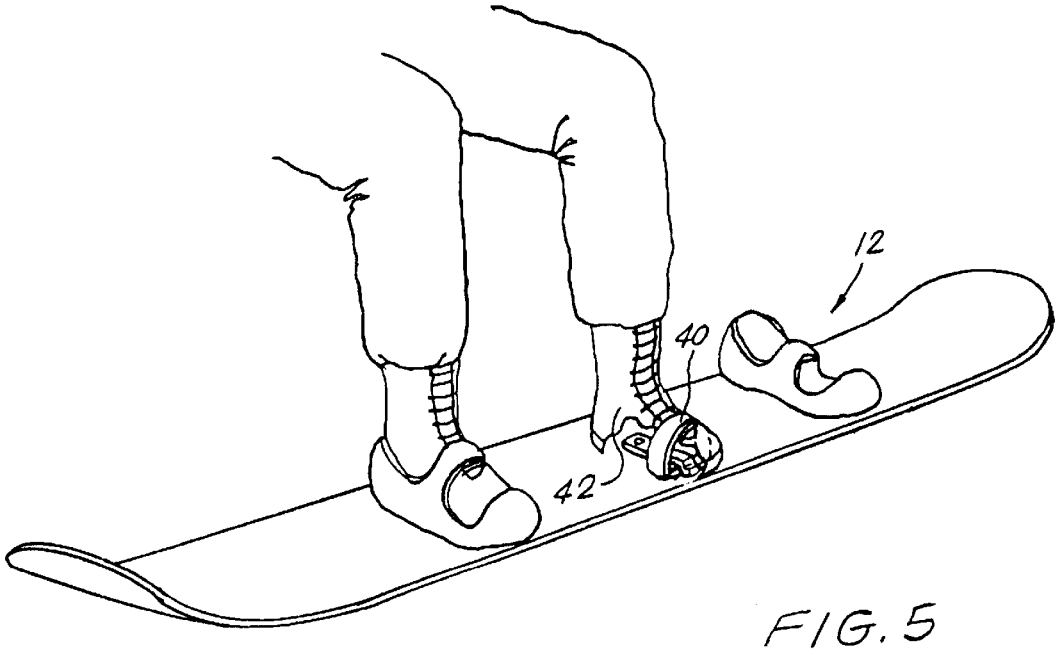
FIG. 5 (PRIOR ART)
FIG. 5 is a diagrammatic illustration of a prior art device for the support of a snowboard during chair lifting in which the support consists of a loop which is bolted to the snowboard between the two bindings thereof.

In order to eliminate such problems and referring now to FIG. 5, in the prior art a toe loop 40 is provided for the left foot of the individual, with the toe loop being bolted as illustrated at 42 to board 12. As mention hereinbefore, the bolting or screwing of the toe loop to the board often results in a fracture of the board or a weakening such that the manufacturer's warranties for the board are voided.

Figure 6:
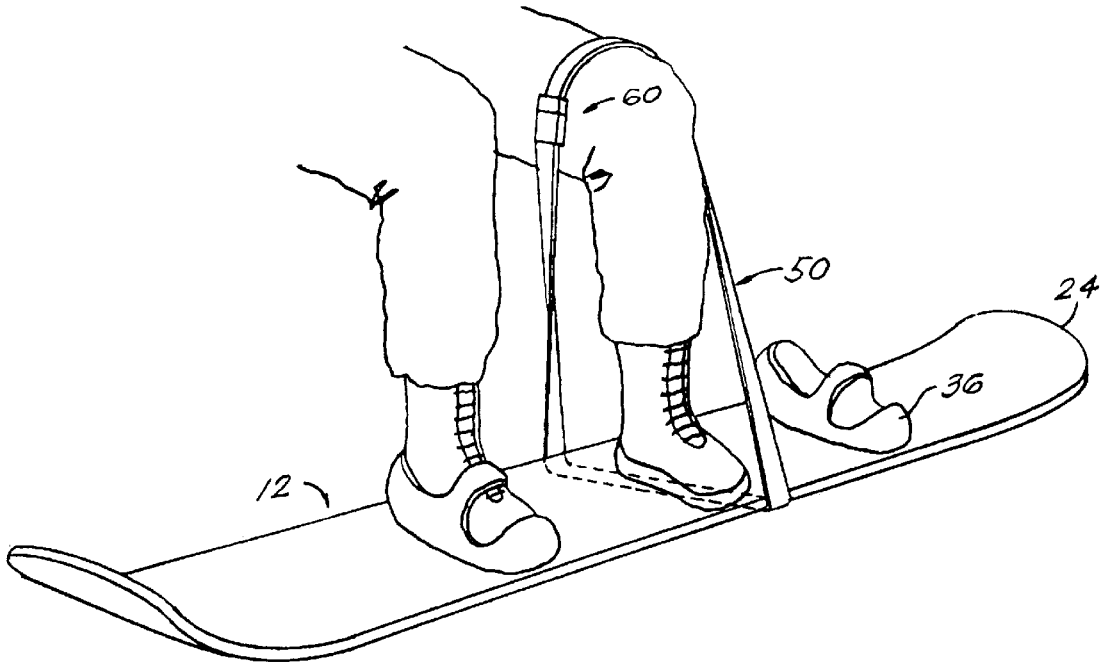
FIG. 6 is a diagrammatic illustration of the subject invention in which a webbed strap is looped around the snowboard during chair lifting in which the web passes over the thigh of the person on chairlift to provide support of the dangling portion of the snowboard by virtue of the co-action of the web with the thigh, the underneath side of the snowboard and the individual's foot on top of the snowboard to keep the strap in place; and, FIG. 7 is a detailed view of the webbed strap of FIG. 6, illustrating the quick disconnect buckle at the distal ends of the strap to permit rapid assembly while on the chairlift and rapid disassembly upon disembarking.

As illustrated in FIG. 6, rather than using the garter belt or toe loop system as described above, in the subject system a webbed loop strap 50 is utilized which supports board 12 conveniently at any location between bindings 16, with the web passing over thigh 52 of the individual such that the support for the board accomplished through the co-action of foot 54 on top surface 56 of the bard 12 in combination with the strap portion 58 as it coacts with the individual's thigh.

It will be appreciated that in this embodiment, there are no bolts or screws through the board. Moreover, the position of the support strap is at the user's convenience and discretion since the strap can be made to contact the board at any position between the two bindings.

Also note that a quick release mechanism 60 in the form of a buckle is provided such that upon disembarking the strap is quickly removed and stowed on the individual. This means that none of the apparatus used for supporting the board during chair lifting is left on the board during normal use.

Moreover, supporting the board on a general horizontal element, namely the thigh, eliminates the torque on the ankle and the knee which constitute points of injury.

Figure 7:
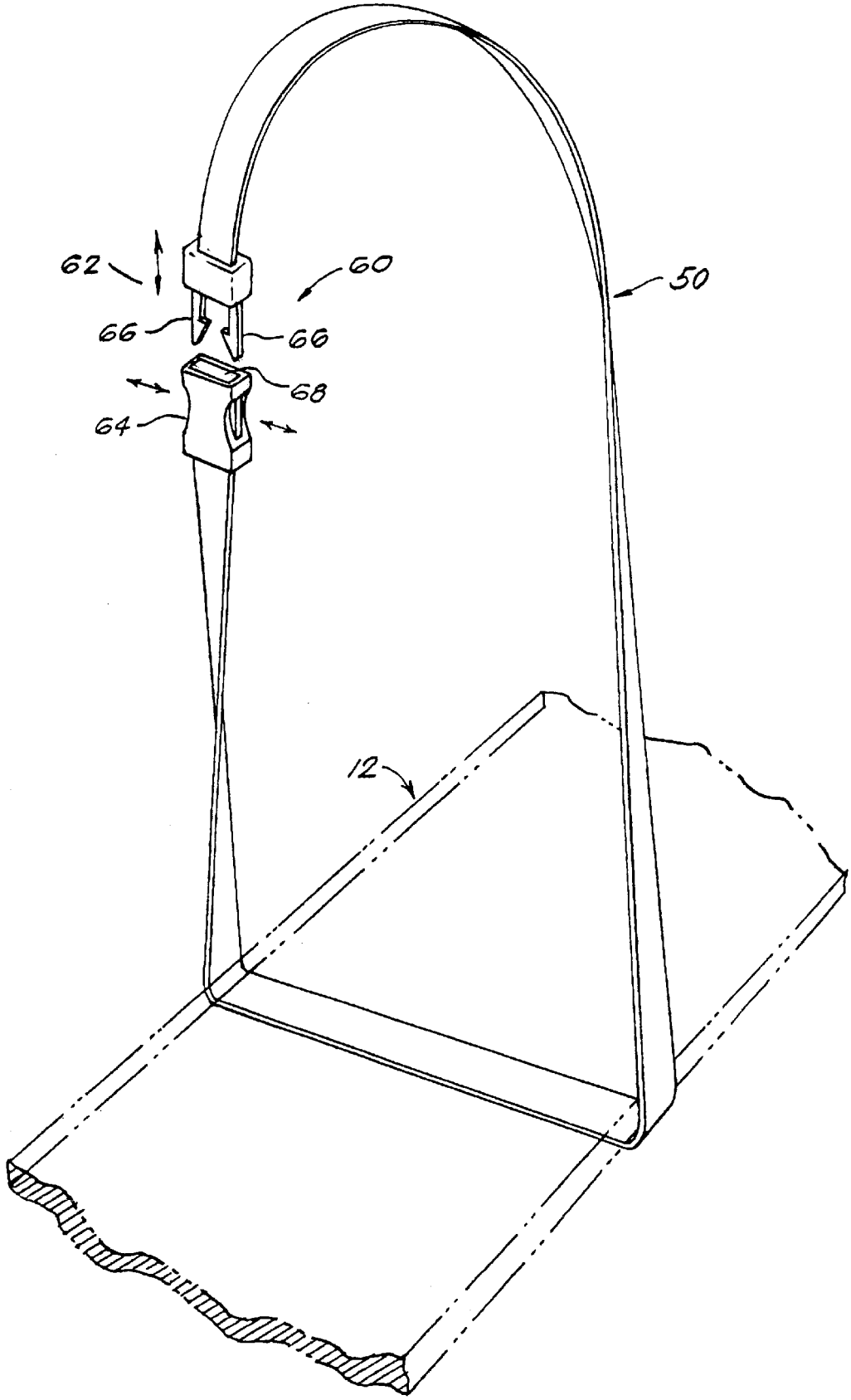

Referring now to FIG. 7, strap 50 is shown in position on the snowboard 12, with the quick disconnect 60 being illustrated as having a male portion 62 and a female portion 64, with teeth 66 of male portion 62 adapted to be inserted into channel 68 of female portion 64 where they grab an internal latching surface.

What will be appreciated is that the use of the subject mechanism, snowboards can be safely and conveniently transported up a chairlift, with the support strap being easily attached and removed without comprising the structural stability of the board. Moreover, the support strap is easily adjustable in length and easily positioned along the length of the snowboard. A universal device is thus provided for snowboard transport and protection of the individual.

Having now described a few embodiments of the invention, and some modifications and variations thereto, it should be apparent to those skilled in the art that the foregoing is merely illustrative and not limiting, having been presented by the way of example only. Numerous modifications and other embodiments are within the scope of one of ordinary skill in the art and are contemplated as falling within the scope of the invention as limited only by the appended claims and equivalents thereto.

What is claimed:

1. A method for prevention of injury to an individual transporting a snowboard on a chairlift comprising the steps of:

locating a portion of a looped strap around the free end of a snowboard having bindings;

placing one foot of the individual in a binding at the other end of the snowboard; and, positioning another portion of the looped strap over the leg of the individual associated with the other foot, whereby the snowboard is supported by the individual riding the chair lift by the foot in the binding and by the looped strap.

2. The method of claim 1, wherein the strap is a webbed strap.

3. The method of claim 1, wherein the strap includes a quick disconnect coupling accessible by the individual at the leg over which the strap lies and further including the steps of connecting the coupled ends of the strap after looping the strap around the free end of the snowboard and disconnecting the coupling prior to disembarking the chairlift.

4. The method of claim 1, wherein the snowboard has pair of spaced-apart bindings and wherein the portion of the strap around the snowboard is located between the bindings and contacts the underside of the snowboard.

5. The method of claim 1, and further including the step of resting the other foot on the top of the snowboard to put tension on the strap.

* * * * *